United States Patent [19]

O'Malley

[11] 3,967,962

[45] July 6, 1976

[54] DEVELOPING WITH TONER POLYMER HAVING CRYSTALLINE AND AMORPHOUS SEGMENTS

[75] Inventor: James J. O'Malley, Webster, N.Y.

[73] Assignee: Xerox Corporation, Stamford, Conn.

[22] Filed: Oct. 22, 1975

[21] Appl. No.: 624,676

Related U.S. Application Data

[63] Continuation of Ser. No. 418,628, Nov. 23, 1973, abandoned.

[52] U.S. Cl. ..... 96/15 D; 252/62.1 P; 427/22

[51] Int. Cl.[2] ..... G03G 13/08; G03G 9/02

[58] Field of Search ..... 96/15 D, 1 LY; 252/62.1; 427/17, 22

[56] References Cited

UNITED STATES PATENTS

| | | | |
|---|---|---|---|
| 2,940,934 | 6/1960 | Carlson | 96/15 D X |
| 3,502,582 | 3/1970 | Clemens et al. | 252/62.1 |
| 3,639,243 | 2/1972 | Okuno et al. | 252/62.1 |
| 3,657,130 | 4/1972 | Machida et al. | 252/62.1 |
| 3,753,760 | 8/1973 | Kosel | 427/17 |

FOREIGN PATENTS OR APPLICATIONS

| | | |
|---|---|---|
| 1,179,095 | 1/1970 | United Kingdom |

*Primary Examiner*—Roland E. Martin, Jr.

[57] ABSTRACT

This invention is directed toward a method for obtaining a resinous toner image fixed to a copy substrate. The method involves applying to a copy substrate in image configuration a toner of specific polymeric composition and fixing the image to the copy substrate by the application of heat sufficient to fuse the toner. The toner composition comprises a finely divided mixture comprising a coloring material and a polymeric material which is block or graft copolymer consisting of at least one crystalline or crystallizable polymeric segment chemically linked to at least one amorphous polymeric segment, said crystalline or crystallizable segment individually having a glass transition temperature of less than about 20°C and a melting point of at least about 45°C, and said amorphous segment individually having a glass transition temperature less than the melting point of said crystalline or crystallizable segment. Toner materials according to the present invention exhibit thermal and mechanical properties which render them extremely useful in xerographic processes, particularly high speed process involving contact or flash fusing.

14 Claims, No Drawings

DEVELOPING WITH TONER POLYMER HAVING CRYSTALLINE AND AMORPHOUS SEGMENTS

This is a continuation of application Ser. No. 418,628, filed Nov. 23, 1973, now abandoned.

BACKGROUND OF THE INVENTION

The present invention relates to electrophotographic imaging processes involving development and fixation of toner images wherein the resinous component of the electrostatographic toner comprises a block or graft copolymer having crystalline and amorphous segments.

The formation and developement of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely divided electroscopic material referred to in the art as "toner". The toner will normally be attracted to those areas of the layer which retain a charge, thereby forming a toner image corresponding to the electrostatic latent image. This toner image may then be transferred to a copy substrate such as paper. The transferred image may subsequently be permanently affixed to the copy substrate such as by fusion with heat. Instead of forming the latent image by uniformly charging the photoconductive layer and then exposiing the layer to a light and shadow image, one may form the latent image by directly charging an insulating layer, which can be either photoconductive or non-photoconductive, in image configuration. The powder may be fixed directly to the insulating layer if desired.

One of the important applications of electrostatography comprises its use in automatic copying machines for general office use wherein an electrostatic latent image is developed using a developer composition comprising a carrier mixed with fine particles of resinous toner, and the thus formed powder image is transferred to a copy substrate and then fixed thereon. Considerable effort has been expended to provide suitable developers and associated fixing techniques for modern high speed copying machines. The toner material used must have suitable electrostatic properties to permit attraction by the carrier and then selective attraction by the latent images. It must further be physically strong to permit constant recycling in a bouncing type of movement. The toner must further be resistant to blocking or aggregating at ordinary operating temperatures, but yet be capable of being readily fixed to the copy sheet.

Fixing techniques employing heat, pressure, solvents and various combinations thereof have been devised; however, each of these systems is subject to severe practical limitations which inhere in the systems themselves and also the toner compositions heretofore available. Whatever method of fixing is used, speed, effectiveness, and simplicity in operation are the principal, desirable characteristics to be obtained. The most commonly employed fixing techniques employ the use of heat alone or heat in combination with pressure. The toner materials employed must melt or block sufficiently above the ordinary operating temperatures of the machines involved to assure convenient storage and handling. However, the materials must also melt at a practically low temperature to avoid excessively-high energy consumption and possible heat damage to the copy substrate or delicate machine parts.

It has long been recognized that one of the fastest and most positive methods of applying heat for fusing the powder image to paper is to bring the powder image into direct contact with a hot surface, such as a heated flat plate or roller. However, it was found that as a powder image is tackified by contact heating, part of the image carried by the copy sheet would stick to the hot surface so that as the next copy sheet was contacted with the hot surface, the tackified image partially removed from the first sheet would partially transfer to the next sheet and, at the same time, part of the tackified image from said next sheet would adhere to the hot surface. This phenomenon is commonly referred to in the printing art as "offset". For a given system, this upper temperature limit is referred to as the "hot offset temperature". Thus, contact heat fusers are inherently limited to the use of temperatures and toners which do not cause hot offset of the toner material.

Various types of polymeric materials have been proposed in the prior art for use as the resinous component in electrostatographic toners. U.S. Pat. No. RE 25,136 teaches toner material based on polystyrene or copolymers of styrene with monomers such as alkyl methacrylates. British Pat. No. 1,179,095 teaches toner material based on a combination of two polymeric materials, one of which polymeric materials has a glass transition temperature of greater than 20°C, and the other a glass transition temperature of at least 5°C lower. These polymeric materials may be combined by physical admixture, or by forming block or graft copolymers. Other patents of interest in the electrostatographic toner area include U.S. Pat. Nos. 2,788,288; 3,078,342; 3,391,082; 3,502,582; 3,510,338; 3,609,082 and 3,647,696. As indicated above, these other toner materials based on amorphous polymers have not proven entirely satisfactory when used with contact heat fusers.

While further advances in the art of fixing, including the use of offset reducing roller surfaces, have provided more suitable means to fuse toner images through the use of heat and pressure with decreased offset, these devices are still restricted to operate within close temperature tolerances due to the narrow fusing latitudes obtainable with toner materials heretofore available. Exemplary of these contact fusing devices are those disclosed in U.S. Pat. Nos. 3,256,002, 3,268,351, 3,291,466, 3,437,032, 3,498,596, and 3,539,161.

SUMMARY OF THE INVENTION

It has now been discovered that electrostatographic toner material having exceptionally desirable mechanical and thermal properties may be prepared by forming a finely divided mixture comprising a coloring material and a polymeric material which is block or graft copolymer consisting of at least one crystalline or crystallizable polymeric segment chemically linked to at least one amorphous polymeric segment, said crystalline or crystallizable segment individually having a glass transition temperature of less than about 20°C and a melting point of at least about 45°C and said amorphous segment individually having a glass transition temperature less than the melting point of said crystalline or cyrstallizable segment. In the preferred embodiment, the glass transition temperature of both polymeric segments is less than about 0°C and within the range of about 0° to −100°C, and the melting point of the copolymer lies within the range of about 45° to about 150°C. The amount of amorphous polymer present in the toner copolymers of this invention is preferably within the range of about 10 to 90% by weight based on total polymer weight. Toner materials prepared according to the present invention exhibit thermal and mechanical properties which render them extremely useful in xerographic processes, particularly high speed processes involving heat contact fusing. The thermal properties of the instant toner materials are such that they exhibit an extremely low latent heat of fusion while substantially retaining melting point and melt crystallization characteristics of toner materials based on crystalline or crystallizable homopolymers, thereby allowing for a broad latitude of fusing temperature without toner offset.

DETAILED DESCRIPTION OF THE INVENTION

In pressure roll fixing of electrostatographic toners, three interrelated parameters of utmost importance in toner performance are: (1) the minimum fusing temperature, which is the minimum temperature required for fusing the toner; (2) the hot offset temperature, which is the minimum temperature at which the hot toner melt begins to adhere to the pressure member, i.e., the maximum temperature of operation which avoids this type of fixing failure; and (3) the fusing latitude, which is the operating range defined as the difference between the hot offset temperature and minimum fusing temperature.

Viscosity-temperature relationships for toner materials have been established, and it is found that a certain viscosity range is required for the onset of fusing. A second, somewhat lower, viscosity range has been found to correspond to offsetting. The difference between these viscosity ranges is called the "fusing window". The fusing window depends to a great extent on specific machine parameters, such as components, configuration, speed, etc. For maximum range of fixing operation, i.e., maximum fusing latitude, one requires a toner having a minimum temperature dependence on viscosity and maximum traverse of the fusing window.

Whereas toner materials of the prior art containing amorphous polymeric material exhibit a minimum fusing temperature usually in excess of 150°C, and a fusing latitude in many cases of less than 20°C., it has been found that toner based on crystalline or crystallizable polymers specifically satisfy the aforementioned thermal and viscosity criteria. Crystalline polymers offer the advantages of relatively sharply defined melting points above which the polymer can be readily induced to flow and below which at the crystallization temperature ($T_C$) the polymer can be readily induced to harden. Crystalline or crystallizable polymers in general also exhibit less tendency to offset or adhere to fusion rollers even when temperatures of greater than 100°C in the excess of the polymer melting point ($T_m$) are encountered during xerographic fusion. In addition, their mechanical properties are such that these materials are more resistant to degradation during processing into toner material.

Although the use of toner material based on crystalline or crystallizable polymers offers some advantages and flexibility in terms of thermal and viscosity criteria particularly in high speed xerographic equipment, one disadvantage lies in the fact that an additional amount of heat energy is required to transform the polymer from a crystalline state to the state where the polymer will flow and adhere to the transfer substrate. This heat energy requirement is known as the "Heat of Fusion" and may be defined as the amount of energy necessary in transforming a polymer from a crystalline or a partially crystalline state to a completely disordered amorphous state without a change in temperature in the crystalline segments of the polymer. The heat of fusion is directly relatable to the degree of crystallinity of a given polymer: the higher the crystallinity, the greater the heat of fusion, and the greater the amount of heat necessary to melt the polymer.

Thus, whereas crystalline polymers offer certain advantages as indicated above, particularly when used as a toner component in a high speed xerographic process, the additional heat necessary for toner fusion tends to mitigate these advantages. In order to overcome the latent heat of fusion and impart the required flowability characteristics into a crystalline polymer such that good adhesion of the toner to the substrate will occur, it may be necessary to either heat the toner bearing recording medium to moderate temperature above $T_M$ for a period of time longer than might be desirable in a high speed operation, or subject the toner bearing substrate for a desirably short period of time to a temperature above $T_M$ which is in excess of that desirable. In the former case, speed is sacrificed; in the latter case, excessive heat and the concomitant disadvantages associated therewith may be encountered. In either case, the latent heat of fusion is a factor tending to mitigate somewhat the previously recited advantages inureing in toner based on crystalline polymers.

It is thus most advantageous to prepare a toner material which offers similar advantages of toner based on a crystalline or crystallizable polymer in terms of mechanical, physical, chemical and thermal properties, but which also exhibits a controllably minimal latent heat of fusion. This is accomplished according to the present invention by providing toner compositions comprising a block or graft copolymer containing at least one crystalline or crystallizable polymeric segment chemically linked to at least one amorphous polymeric segment. Toner compositions based on such segmented copolymers have sharp well defined melting points with minimal heats of fusion, the heat of fusion of a particular copolymer being controlled as a function of the ratio of amorphous to crystalline segments present in the copolymer structure. Of particular advantage is the fact that low heats of fusion can be achieved with a minimal effect on the melting point of the copolymer.

The block copolymers can be characterized as materials represented by any of the following generic schemes: $[BA]_n$, $[AB]_n$, $[ABA]_n$, or $[BAB]_n$, wherein $n$ is a whole number equal to or greater than 1, A represents the amorphous polymeric segment and B represents crystalline or crystallizable polymeric segment. Each segment need not necessarily be homopolymeric. The individual block segments A and B may be linked directly to one another in head to tail fashion such as by covalent bonding resulting from sequential block copolymerization of the appropriate monomers or by coupling reaction between terminal functional groups present on different polymeric molecules. Alternatively, the block segments may be linked by means of difunctional coupling agents which remain in the block copolymer molecules, such as, for example, urethane linkages which would be formed by the reaction of hydroxyl terminated polymers with an organic diisocyanate, or ester linkages formed by the reaction of hydroxy terminated polymers with dicarboxylic acids or carboxy terminated polymers with glycols, or other linkages formed by reaction of hydroxy terminated polymers with phosgene, dichlorodimethyl silane and the like.

Where the block copolymrs are formed using difunctional coupling agents, the above recited formula schemes for such block copolymers should be considered generic to a specific scheme wherein the coupling agent moiety is present in the block copolymer molecule connecting the A segment to the B segment. In turn, each A or B segment depicted generically above may comprise a plurality of individual A segments coupled together or a plurality of B segments coupled together. Thus, for example, the formula $[BA]_n$ should, for the purposes of the present invention, be considered generic to $[B^1]$-C-$[A^1]$ wherein each $B^1$ and $A^1$ segment may consist of a single polymeric molecule or a plurality of polymeric molecules of similar structure coupled together, such as where $[B^1]$ is B or [(B-c-(mB] and $[A^1]$ is A or [A(-c-A)m], further wherein A and B are as specified above, *m* is a positive whole integer equal to 1 or greater, and *c* is the coupling agent moiety. The same holds true for the three other generic formula schemes recited above. Although the coupling technique is preferred because it offers more precise control over the amounts of each type of polymer introduced into the polymer chain, it is to be emphasized that any polymerization technique known to those skilled in the art affording the capability of preparing the tailor-made block copolymers of the present invention may be used.

The graft copolymers used as a toner ingredient according to the present invention can be categorized generically as branched polymers exemplified by the following schemes:

```
(I)   ...AAAAAAAA...      (II)   ...BBBBBBBB...
          .                          .
          B                          A
          B                          A
          B                          A
          .                          .
          .                          .
```

wherein A represents repeating momomeric units contained in the amorphous polymeric segment and B represents repeating monomeric units contained in the crystalline or crystallizable polymeric segment. As in the case of the block copolymers, the A and/or B segments may be homopolymeric or copolymeric. The grafted polymer chain may be present at any position along the polymer backbone chain, including at the head or tail of the backbone polymer. In most instances a plurality of such grafted polymer chains may be present at various points along the backbone. Where the crystalline or crystallizable polymer comprises the backbone chain, the degree of branching or grafing is preferably minor in order to preserve the crystalline properties of the graft copolymer; where the grafted side chains comprise the crystalline or crystallizable polymer, then a larger number of side chains are desirable for the same reason. The graft copolymers may be prepared by techniques well known to those skilled in the art. Such techniques include creating a free radical site or sites along a polymer chain by irradiation or other technique with subsequent polymerization of monomer in the presence of the polymer; introducing active sites along the polymer chain by oxidation to create peroxide groups which act as free radical initiators with subsequent polymerization of monomer; and by coupling reactions performed by either introducing functional groups along the chain by metallation or other techniques, or utilizing functional groups already present, which functional groups can be made to react either directly with a terminal functional group present in a second polymer or indirectly by means of coupling agents. As is the case with the block copolymers, the preferred technique for forming graft copolymers involves reacting preformed polymers because of the more precise control regarding polymer selection and degree of grafting.

Where the block or graft copolymers are prepared by polymerizing a monomer or monomers in the presence of a preformed polymer, the choice of monomer, catalyst and polymerization conditions must be such that the polymerizing monomers will form a polymer having the desired crystalline, amorphous or isomer structure. Where the preformed polymer is amorphous, the polymerizing monomer and polymerization conditions should be such as to lead to the formation of a crystalline or crystallizable polymer; and vice versa. Sequentially polymerized block copolymers are most conveniently prepared by solution polymerization using organo-metallic catalysts or the active Ziegler or Natta catalysts which give rise to the so-called "living polymers;" graft copolymers are most conveniently prepared by solution or suspension polymerization involving dissolving or dispersing the backbone polymer in a liquid medium which medium contains grafting monomer, free radical initiator and polymerization catalyst.

The number average molecular weight of the copolymers employed in the toner compositions of the present invention should be within the range of about 5,000 to 200,000 g/mole for best results. At molecular weights of less than about 5,000 it is found that the copolymer may exhibit hot offsetting due to the low melt viscosity encountered at this low molecular weight; above about 200,000 g/mole, the copolymer is more difficult to fuse or fix in the xerographic process. The preferred range for optimum hot melt properties is about 15,000 to 150,000 g/mole. The individual amorphous or crystalline polymer segments forming the block or graft copolymer preferably have a number average molecular weight within the range of about 1,000 to 20,000 g/mole, with a preferred range of about 2,000 to 12,000 g/mole.

As indicated above, segmented copolymers derived from monomers polymerized to form crystalline or crystallizable polymers having a crystalline $T_M$ in the range of about 45° to 150°C and a $T_G$ within the range of about 20° to −100°C are particularly suitable for the purposes of this invention. Examples of suitable genus and species polymers are: Polyesters, including polyalkylene polyesters wherein the alkylene group contains at least two carbon atoms such as polydecamethylene sebacate, polydecamethylene succinate, polyethylene sebacate, polyethylene succinate, polyhexamethylene sebacate, polyhexamethylene suberate, polyhexamethylene succinate and the like; aromatic polyesters such as poly-p-xylene adipate or polydiethylene glycol terphthalate; polyvinyl esters and ethers such as polyvinyl ethyl ether, polyvinyl butyl ether, polyvinyl 2-methoxyethyl ether, polyvinyl stearate and the like; polysulfides and sulfones such as polydecamethylene sulfide, polyhexamethylene sulfide, polytetramethylene sulfone and the like; polyethers such as polybutadiene oxide, polyethylene oxide, polypropylene oxide and the like; polyepihalohydrins such as polyepifluorohydrin; polyenes including cis and trans polydienes such as cis 1, 4 polybutadiene and 1,2 trans polybutadiene; polyolefins such as poly-1-pentene, poly-1-hexadecene, polybutene, poly-3-methyl-1-butene and the like; cellulose polymers such as cellulose tricaprate; polyacrylates such as polyisobutyl acrylate; polyacids; polyamides; polyurethanes; and like polymers. Copolymers derived from monomers constituting two or more of the above polymers may also be used. Particularly preferred as crystalline segments in the block or graft copolymers are those polymers and copolymers having a $T_M$ within the range of about 55°C to about 120°C.

The amorphous segment of the block or graft copolymers may similarly be selected from a wide variety of polymeric materials having a $T_G$ less than the $T_M$ of the crystalline polymer segment with which it is to be associated in the block or graft copolymer. The $T_G$ of the amorphous segment is preferably less the 0°C. Examples of suitable amorphous polymers include atactic polymers derived from the same or different monomers or monomer isomers used to form the crystalline or crystallizable segment of the copolymer recited above, said monomers polymerized under conditions such that atactic rather than isotactic structure results. Suitable classes of amorphous polymers include polyvinyl ethers; atactic polyolefins; polyacrylates; polyoxides such as polypropylene oxide; polysulfides; unsymmetrically branched polyesters and polyamides; aliphatic polyurethanes; and like materials.

It has been further found that electrostatographic or triboelectric properties of the present toner materials may be optimized and best controlled by employing isomeric copolymers, that is, copolymers wherein the crystalline and amorphous segments have identical chemical compositions but, of course, different chemical structures. Examples of such copolymers would be block or graft copolymers wherein the crystalline segment comprises polybutene-1 or -2, and the amorphous segment comprises polyisobutylene; copolymers wherein the crystalline segment is polyhexamethylene sebacate and the amorphous segment is poly-(2-methyl, 2-ethyl, 1,3-propylene sebacate). Other combinations include isotactic poly (vinyl n-propyl ether) and atactic poly (vinyl isopropyl ether; poly (trimethylene sulfide) and poly (propylene sulfide); poly (hexamethylene oxide) and atactic poly (vinyl butyl ether); isotactic poly (isobutyl acrylate) and atactic poly (n-butyl acrylate). Other isomeric combinations will occur to those skilled in the art.

As indicated above, for best results the segmented copolymers should exhibit a $T_m$ within the range of about 45°C to about 150°C and a $T_G$ within the range of about 20°C to −100°C. In order to avoid the possibility of blocking under extreme conditions, it may be desirable to select crystalline and amorphous segments such that the copolymers have a $T_m$ in excess of about 55°C and a $T_G$ of less than 0°C.

The block or graft copolymers may be fabricated into electrostatographic toner using any of the known techniques of the prior art by mixing the copolymers with a colorant material. Mixing may be accomplished by dispersing the colorant in the melted copolymer, hardening the polymer and pulverizing the composition in a device such as a jet or hammermill to form it into small particles. Alternatively, mixing may be carried out by combining the colorant with a solution, dispersion or latex of the copolymer, followed by recovery of the copolymer/colorant mixture in finely divided form by spray drying techniques. Suitable methods of mixing are more thoroughly described in U.S. Pat. No. 3,502,582. The average particle size of the processed toner should be within the range of about 1 to 30 microns, preferably between about 3 to 15 microns. A subsequent screening or sizing operation may be necessary to produce a toner having this particle size distribution.

The colorant material used in preparing the toner composition may include any pigment or water or organic solvent soluble dye. The most common pigments used in electrostatographic toner materials are finely divided carbon black, cyan, magenta and yellow pigments. The most common dyes are the acid, basic and dispersed dyes of suitable color as are known in the art. Typical examples of suitable colorants are discussed in U.S. Pat. No. 3,502,582. The pigment or dye should be present in the amount effective to render the toner highly colored so that it will form a clearly visible image on a recording member. Preferably, for sufficient color density the pigment is employed in an amount from about 1% to about 20% by weight, based on the total weight of the color toner. If the toner colorant employed is a dye, quantities substantially smaller than about 1% by weight may be used.

The toner composition may be formulated into an electrostatographic developer composition by combining the finely divided toner with a suitable carrier material such that the toner forms a coating on the carrier. The toner and carrier material may be premixed or mixed inside the developer region of the xerographic machine. Where the development process in the well known magnetic brush process, the carrier material will be a magnetically attractive material such as finely divided iron particles of about 60 to 120 mesh size. For other than magnetic brush development, the carrier material may be of any of the known particulate substances exhibiting appropriate triboelectric effects such that the carrier particles impart a charge to the finer toner whereby the toner adheres to and coats each carrier particle. Examples of suitable carriers are inorganic salts, glass, silicon and other materials such as disclosed in the aforementioned U.S. Pat. No. 3,502,582. The particle size of the carrier should be significantly greater than the toner, preferably within the range of about 50 to 1000 microns. The toner is most effectively employed at a level from about 0.5 to 10 parts by weight per 100 parts by weight of carrier material.

The toner and developer compositions of the present invention may also contain any of the additives known to be included in such compositions such as lubrication aids, antioxidants, sensitizing agents, polymeric or non-polymeric plasticizers, and the like.

DESCRIPTION OF THE PREFERRED EMBODIMENT

The following specific embodiment illustrates the preparation of toner material wherein the polymeric component comprises an isomeric block copolyester prepared by coupling crystalline poly (hexamethylene sebacate) [poly HMS] and amorphous poly (2-methyl- 2-ethyl-1,3-propylene sebacate) [poly MEPS] using hexamethylene diisocyanate as the coupling agent whereby urethane linkages are formed. The block copolyester was prepared by initially individually synthesizing polyHMS and poly MEPS, and then subjecting a mixture of these homopolymers to a coupling reaction as hereinafter described.

EXAMPLE 1

Crystalline poly (hexamethylene sebacate) was prepared using a kettle equipped with a stirrer, nitrogen gas inlet tube, thermometer and condenser by reacting sebacic acid with 1,6hexamethylene glycol in the presence of a p-toluenesulfonic acid catalyst as follows: sebacic acid and hexamethylene glycol were added to the reaction kettle in a respective 1.0 to 1.1 molar ratio along with 0.5 wt % p-toluenesulfonic acid. The 10 mole % excess of glycol was used to ensure the predominant presence of hydroxyl end groups in the reaction product. The mixture was heated to 165°C while stirring. At 165°C, an amount of xylene was added to assist refluxing and this temperature was maintained until water evolution ceased (4 hrs.). Afterwards, the condensers were removed and the excess glycol and catalyst were removed by sparging with nitrogen for 0.5 hours at 165°C. On cooling to room temperature, the poly (hexamethylene sebacate) crystallized into an off-white solid. Next, the poly (HMS) from above was purified by precipitation from a benzene solution into methanol using techniques well known in the art. The precipitated poly (HMS) was collected by filtration and dried in vacuo. Analytical data on this purified material indicate an acid number of 1.06, an hydroxyl number of 34.4, an $\overline{M}_n$ of 3165 g/mole, an MWD ($M_w/M_n$) of 1.41 by GPC in chloroform, a glass transition temperature of about −62°C and a crystalline melting point of about 65°C.

EXAMPLE 2

Amorphous poly (2-methyl-2-ethyl-1,3-propylene sebacate) was prepared by reacting sebacic acid and a 10 mole % excess of 2-methyl-2-ethyl-1,3-propylene glycol in the presence of 0.5 weight % p-toluenesulfonic acid in the same manner as in Example 1. On cooling to room temperature after the polymerization, the poly (MEPS) remained as a clear, tacky fluid. Analysis indicates it has an acid number of 2.40, an hydroxyl number of 19.4, an $\overline{M}_n$ of 5150 g/mole, an MWD of 1.87 by GPC in chloroform, and a glass transition temperature of about −61°C.

EXAMPLE 3

A block copolyester was prepared by coupling the hydroxy terminated poly (HMS) prepared in Example 1 and the hydroxy terminated poly (MEPS) prepared in Example 2 using hexamethylene diisocyanate as the coupling agent according to the following procedure: three parts by weight of poly (HMS) of Example 1 were mixed with one part by weight of poly (MEPS) of Example 2 in a reaction kettle equipped with a stirrer, nitrogen gas inlet tube, thermometer and condenser. The mixture was heated to 135°C with stirring, and hexamethylene diisocyanate was added at a level of 4.5% by weight of the fluid polymeric mixture. The temperature was maintained at 135°C. Within 10 minutes the viscosity was such that the polymeric mass began to envelop and climb the stirrer. The coupling reaction was terminated after 1 hour and the copolymer was dissolved in benzene and precipitated with stirring into methanol. The precipitate was collected by filtration, washed thoroughly with methanol and dried in vacuo. A yield of about 89% was realized from this coupling reaction. The block copolyester was analyzed by Nuclear Magnetic Resonance to contain 78.6% poly (HMS) and 21.4% poly (MEPS). It had an intrinsic viscosity in chloroform of 0.90 dl/g at 25°C, a molecular weight believed to be about 45,000 ± 15,000 g/mole, crystalline melting point of about 63°C, and a glass transition temperature of about −60°C.

Although the structure of the block copolymer molecules produced according to Example 3 is not precisely known, it is believed that because of the predominant presence of segments of polymerized (HMS) in the block copolymer, the copolymer statistically comprises a plurality of repeating crystalline poly HMS segments connected by urethane linkages, said repeating segments in turn connected by urethane linkages with the amorphous poly (MEPS) segments at various random points along the block copolymer chain, such as illustrated in the following scheme:

. . . B-c-B-c-B-c-A-c-B . . .

wherein
B represents polymerized (HMS)
A represents polymerized (MEPS)
and C represent $$-O-\overset{O}{C}-\overset{H}{N}(CH_2)_6\overset{H}{N}-\overset{O}{C}-O-$$

This segment of structure conforms to the generic structure BAB, a species of which generic structurre for this copolymer is $[B^1]$-c-$[A^1]$-c-$[B^{11}]$, wherein
$B^1$ is $[-(B\text{-}c\text{-})_2B]$
$A^1$ is A
and $B^{11}$ is B

EXAMPLE 4

A xerographic toner material was prepared by forming a mixture of the block copolyester of Example 3 and a finely divided pigment grade carbon black.

A mixture comprising 95 parts by weight of the block copolyester of Example 3, and 5 parts by weight of Molocco H carbon black was formed by heating the copolyester to a temperature above its melting point, dispersing therein the carbon black, and mixing until a uniform dispersion of the carbon black in the block copolyester was obtained. The mixture was then quick cooled to a temperature below the melting point of the block copolyester.

Finely divided toner material having an average particle size in the order of about 20 microns was prepared by comminuting the above mixture first in a Fitz mill and subsequently in a jet pulverizer.

The toner was tested by employing it as the toner in a "Xerox 3600" copy machine embodying a contact heat fusing device and found to produce very satisfactory copies without toner offset on the fusing roll.

EXAMPLES 5 – 11

Several additional samples of isomeric block copolyesters having various ratios of poly (HMS) and poly (MEPS) were prepared by coupling the poly (HMS) of Example 1 and the poly (MEPS) of Example 2 using various coupling agents. Synthesis data for these copolyesters is shown in Table 1.

The block copolyesters of Examples 5, 7, 9, 10 and 11 were prepared by the method of Example 3; with regard to the block copolyesters of Examples 6 and 8, the procedure of Example 3 was modified somewhat in that refluxing was carried out in chlorobenzene (132°C) containing a small amount of pyridine. General techniques for preparing linear copolyesters using coupling agents are known in the art as, for example, disclosed in U.S. Pat. No. 2,691,006.

TABLE I

| Sample | Poly HMS (parts by weight) | Poly MEPS (parts by weight) | Coupling Agent | Yield (%) | % HMS in Copolymer | T(m) Copolymer |
|---|---|---|---|---|---|---|
| Ex 5 | 15.0 | 15.0 | $(CH_2)_6(NCO)_2$ | 91.4 | 56.3 | 60°C |
| Ex 6 | 3.8 | 6.2 | $COCl_2$ | 70.0 | 56.8 | 60°C |
| Ex 7 | 3.8 | 6.2 | $(CH_2)_6(NCO)_2$ | 83.0 | 50.3 | 58°C |
| Ex 8 | 3.8 | 6.2 | $(CH_3)_2SiCl_2$ | 61.0 | 47.2 | 57°C |
| Ex 9 | 6.22 | 10.3 | $(CH_2)_6(NCO)_2$ | 87.0 | 40.6 | 55°C |
| Ex 10 | 6.33 | 10.3 | $C_6H_4(NCO)_2$ | 90.4 | 38.8 | 55°C |
| Ex 11 | 7.5 | 22.5 | $(CH_2)_6(NCO)_2$ | 84.4 | 28.0 | 53°C |

The copolymers of Examples 5 – 11 were each processed into toner material by the method of Example 4 and each performed satisfactorily when used in a xerographic machine.

As indicated above, toner materials based on the segmented copolymers of the present invention exhibit minimal latent heats of fusion and at the same time the sharp, well defined melting points desirable in a toner material. This may be illustrated by a comparison of the latent heats of fusion ($\Delta H_u$ — in calories/gm.) and melting points ($T_m$) for a plurality of polymer samples containing polymerized hexamethylene sebacate (HMS) and polymerized 2 methyl-2-ethyl-1,3-propylene sebacate (MEPS).

EXAMPLE 12

A series of homopolymer blends having various weight ratios between about 20–80% of poly (HMS) and poly (MEPS) were prepared by forming intimate admixtures of the poly (HMS) prepared according to Example 1 and the poly (MEPS) prepared according to Example 2.

A series of block copolymer samples having various weight ratios between about 20–80% of poly (HMS) and poly (MEPS) were prepared according to the process of Example 3.

A series of random copolymers also having various weight ratios between about 20–80% of polymerized HMS and polymerized MEPS were prepared by a process similar to that described in Example 1 by reacting simultaneously a mixture of 1, 6 hexamethylene glycol, 2-methyl-2-ethyl-1,3, propylene glycol and sebacic acid. Various copolymer compositions were achieved by alterning, systematically, the molar ratio of the two diols in the condensation reacton with sebacic acid. The copolymers so prepared exhibit $M_n$ values within the range of about 2200 to 3600 g/mole.

Samples of each type of polymer composition for various levels of polymerized HMS content were evaluated for latent heat of fusion and crystalline melting point data, the results plotted, and the plots interpolated at 80%, 60%, 40%, and 20% HMS content. Results are shown in Table 2.

TABLE 2

| % HMS | Random Copolymer $T_m$ | Random Copolymer $\Delta H_u$ | Homopolymer Blend $T_m$ | Homopolymer Blend $\Delta H_u$ | Block Copolymer $T_m$ | Block Copolymer $\Delta H_u$ |
|---|---|---|---|---|---|---|
| 100% | 65°C | 30 | 65°C | 30 | 65°C | 30 |
| 80% | 57°C | <10 | 64°C | 25 | 63°C | 17 |
| 60% | 42°C | — | 62°C | 18 | 61°C | 11 |
| 40% | 22°C | — | 62°C | 12 | 56°C | 7 |
| 20% | 0°C | — | 61°C | 6 | 55°C | 6 |

As can be seen from Table 2, the melting point of the random copolymers drops off rapidly as the % HMS in the random copolymer is decreased with a corresponding increase in % MEPS. Below about 60% HMS, the copolymers are a viscous fluid unsuitable for use in a toner composition. With the homopolymer blends, the lowering of $T_m$ is much less severe, but $\Delta H_u$ is found to drop off in almost direct proportion to the amount of poly (HMS) in the blend. With the block copolymers, the lowering of $T_m$ is somewhat greater than in the blend, but still quite acceptable for toner use, but most significantly the drop in $\Delta H_u$ is much higher than in comparable samples of the blend. Thus considerably less heat energy is required to melt or fuse toner based on the block copolymers than is required to melt toner based on the homopolymer blend.

Although the toner composition of the present invention may be used in electrophotographic processes embodying any of the well known techniques of image fixation or fusing such as radiation, vapor, or liquid fusing, it is employed most advantageously in processes involving contact fusing, as discussed above, or flash fusing such as for example disclosed in U.S. Pat. Nos. 3,465,203, 3,474,223, and 3,529,129. In each of these processes, exposure of the image recording medium bearing the powdered toner image, usually paper, to a source of heat is for an extremely limited time duration. In contact fusing, a moving recording medium is exposed to heat while the medium passes through a nip formed by a heated pressure roller and a second support roller. With radiant flash fusing, the recording medium is exposed to heat energy in the form of electromagnetic waves generated usually by a gas lamp, such as a xenon lamp, for a period of timed measured in milliseconds. With each of these processes, a maximum amount of heat energy sufficient to properly fuse the toner without scortching the recording medium is required over a short period of time. It is thus evident that the toner compositions of the present invention having sharp well defined melting points and controllably minimal latent heats of fusion respond particularly well for use in processes involving such fusing techniques.

While the invention has been described with reference to the embodiments disclosed herein, it is not confined to the specific embodiment set forth, and this application is intended to cover such operative modifications or changes as may come within the scope of the following claims.

What I claim is:

1. In an electrophotographic imaging process including the steps wherein a particulate electrostatographic toner composition is applied in image configuration to the surface of a recording member, and said recording member bearing said toner composition in image configuration is subjected to heat or heat and pressure sufficient to fuse said toner composition to the surface of said recording member, the improvement which comprises conducting said imaging process using a finely divided toner composition comprising a uniform mixture of:

a. a colorant material and b. a polymeric material, said polymeric material comprising a segmented copolymer consisting of at least one crystalline or crystallizable polymeric segment chemically linked to at least one isomeric amorphous polymeric segment, said segmented copolymer having a glass transition temperature of less than about 20°C and a melting point of at least about 45°C.

2. The process of claim 1 wherein said polymeric material has an average molecular weight within the range of about 5,000 to 200,000 grams per mole and a melting point within the range of about 45°C to about 150°C.

3. The process of claim 2 wherein said polymeric material is a block copolymer having a formula selected from the group consisting of: $[BA]_n$, $[AB]_n$, $[BAB]_n$, and $[ABA]_n$, wherein A represents the amorphous polymeric segment, B represents the crystalline or crystallizable polymeric segment, and $n$ is a whole number equal to 1 or greater.

4. The process of claim 3 wherein the average molecular weight of said A or B polymeric segments is within the range of about 1,000 to 20,000 grams per mole.

5. The process of claim 2 wherein said segmented copolymer is prepared by chemically reacting at least two preformed polymers, one of said preformed polymers being crystalline or crystallizable and having a glass transition temperature within the range of about 20°C. to −100°C. and a melting point within the range of about 45°C. to 150°C., and another of said preformed polymers being amorphous and having a glass transition temperature of less than 45°C.

6. An electrophotographic imaging process comprising the steps of subjecting the surface of a charged photoconductive insulating layer to a pattern of light and shadow such that an electrostatic latent image is formed on the surface of said layer, developing said latent image by contact of said surface with a developer composition comprising a mixture of carrier particles and toner material, transferring the toner material in image configuration from said surface to the surface of a recording member, and heating the surface of said recording member sufficient to fuse said toner composition to the surface of said recording member, said toner material comprising a finely divided composition comprising a uniform mixture of:

a. a colorant material and b. a polymeric material, said polymeric material comprising a segmented copolymer consisting of at least one crystalline or crystallizable polymeric segment chemically linked to at least one isomeric amorphous polymeric segment, said segmented copolymer having a glass transition temperature of less thant about 20°C, a melting point of at least about 45°C., and an average molecular weight within the range of about 5,000 to 200,000 grams per mole.

7. The process of claim 6 wherein said polymeric material is a block copolymer having a formula selected from the group consisting of: $[BA]_n$, $[AB]_n$, $[BAB]_n$, and $[ABA]_n$, wherein A represents the amorphous polymeric segment, B represents the crystalline or crystallizable polymeric segment, $n$ is a whole number equal to 1 or greater, and wherein the average molecular weight of each A or B polymeric segments is within the range of about 1,000 to 20,000 grams per mole.

8. The process of claim 6 wherein said segmented copolymer is prepared by chemically reacting at least two preformed polymers, one of said preformed polymers being crystalline or crystallizable and having a glass transition temperature within the range of about 20°C. to −100°C. and a melting point within the range of about 45°C. to 150°C., and another of said preformed polymers being amorphous and having a glass transition temperature of less than 45°C.

9. The process of claim 8 wherein said segmented copolymer is a block copolyester having one or more repeating units of crystalline polyester chemically linked to one or more repeating units of amorphous polyester.

10. The process of claim 6 wherein said colorant material is present at a level of from about 1% to about 20% by weight of said composition.

11. The process of claim 10 wherein the average particle size of the toner particles is within the range of about 1 to 30 microns.

12. The process of claim 11 wherein the developer composition comprises from about 0.5 to 10% by weight of toner particles and about 90 to about 99.5% by weight of carrier particles, said carrier particles having an average particle size greater than the toner particles whereby the toner particles adhere to and coat each carrier particle.

13. The process of claim 6 wherein said heating is carried out by passing the recording member through a zone of heat and pressure.

14. The process of claim 6 wherein said heating is carried out by exposing the developed surface of the recording member to electromagnetic radiation.

* * * * *